US011072180B2

(12) United States Patent
Mizutani et al.

(10) Patent No.: US 11,072,180 B2
(45) Date of Patent: Jul. 27, 2021

(54) INK TANK

(71) Applicant: SEIKO EPSON CORPORATION, Tokyo (JP)

(72) Inventors: Tadahiro Mizutani, Shiojiri (JP); Taku Ishizawa, Matsumoto (JP); Noriyuki Fukasawa, Matsumoto (JP); Hideki Okumura, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 73 days.

(21) Appl. No.: 16/573,899

(22) Filed: Sep. 17, 2019

(65) Prior Publication Data

US 2020/0086648 A1 Mar. 19, 2020

(30) Foreign Application Priority Data

Sep. 18, 2018 (JP) ..... JP2018-173250

(51) Int. Cl.
*B41J 2/175* (2006.01)

(52) U.S. Cl.
CPC ..... *B41J 2/17513* (2013.01); *B41J 2/175* (2013.01); *B41J 2002/17573* (2013.01)

(58) Field of Classification Search
CPC ..... B41J 2/17513; B41J 2/175; B41J 2002/17573
See application file for complete search history.

(56) References Cited

U.S. PATENT DOCUMENTS

| | | | | |
|---|---|---|---|---|
| 9,586,407 | B2 | 3/2017 | Kimura et al. | |
| 9,950,535 | B2 | 4/2018 | Kimura et al. | |
| 2014/0043408 | A1* | 2/2014 | Kudo | B41J 29/13 347/86 |
| 2016/0052286 | A1 | 2/2016 | Kimura et al. | |
| 2017/0129246 | A1 | 5/2017 | Kimura et al. | |

FOREIGN PATENT DOCUMENTS

| | | | |
|---|---|---|---|
| JP | 2015-164812 | A | 9/2015 |

* cited by examiner

*Primary Examiner* — Justin Seo
(74) *Attorney, Agent, or Firm* — Oliff PLC

(57) ABSTRACT

An ink tank that communicates with an ink ejecting head, includes: an ink chamber configured to house ink; an ink inlet portion that communicates with the ink chamber and that receives ink supplied from an ink supply container; and an ink viewing portion that is a portion of a wall that defines the ink chamber and that enables the ink in the ink chamber to be viewed from an outside, the ink chamber having an ink guide wall for guiding the ink from the ink inlet portion toward the ink viewing portion.

7 Claims, 14 Drawing Sheets

INK TANK

The present application is based on, and claims priority from JP Application Serial Number 2018-173250, filed Sep. 18, 2018, the disclosure of which is hereby incorporated by reference herein in its entirety.

BACKGROUND

1. Technical Field

The present disclosure relates to an ink tank.

2. Related Art

JP-A-2015-164812 discloses an ink tank into which ink is injected from an ink inlet port. The ink tank is provided with a viewing portion that enables viewing of the amount of ink inside the ink tank from the outside. In this ink tank, ink injected from an inlet portion is guided in a direction away from the viewing portion by a partition wall provided inside the ink tank.

A user, for example, injects ink into the ink tank through the ink inlet port using an ink supply container. However, in the ink tank disclosed in JP-A-2015-164812, because the injected ink is guided in the direction away from the viewing portion, it is difficult to see a rise in the liquid level of the ink through the viewing portion immediately after the start of ink injection. Therefore, there is a possibility that the user may misunderstand that the injection of the ink has not been started although the ink has been injected from the ink supply container.

SUMMARY

According to an aspect of the present disclosure, an ink tank that communicates with an ink ejecting head is provided. The ink tank includes: an ink chamber configured to house ink; an ink inlet portion that communicates with the ink chamber and that receives ink supplied from an ink supply container; and an ink viewing portion that is a portion of a wall that defines the ink chamber and that enables the ink in the ink chamber to be viewed from an outside, the ink chamber having an ink guide wall for guiding the ink from the ink inlet portion toward the ink viewing portion.

DESCRIPTION OF EXEMPLARY EMBODIMENTS

A. First Embodiment

Figure 1:
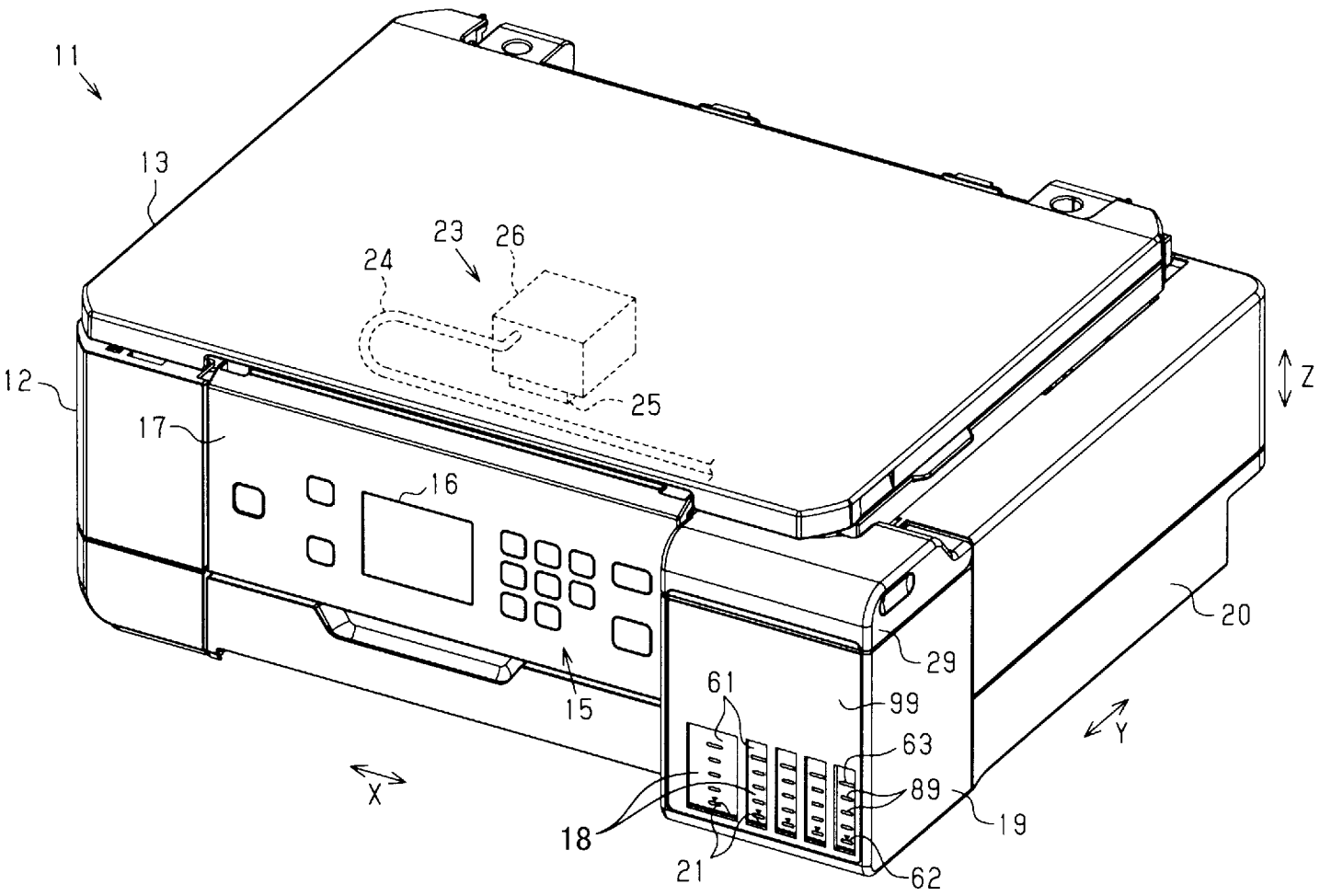
FIG. 1 is a perspective view of a multifunction machine including a printer according to a first embodiment.
Figure 2:
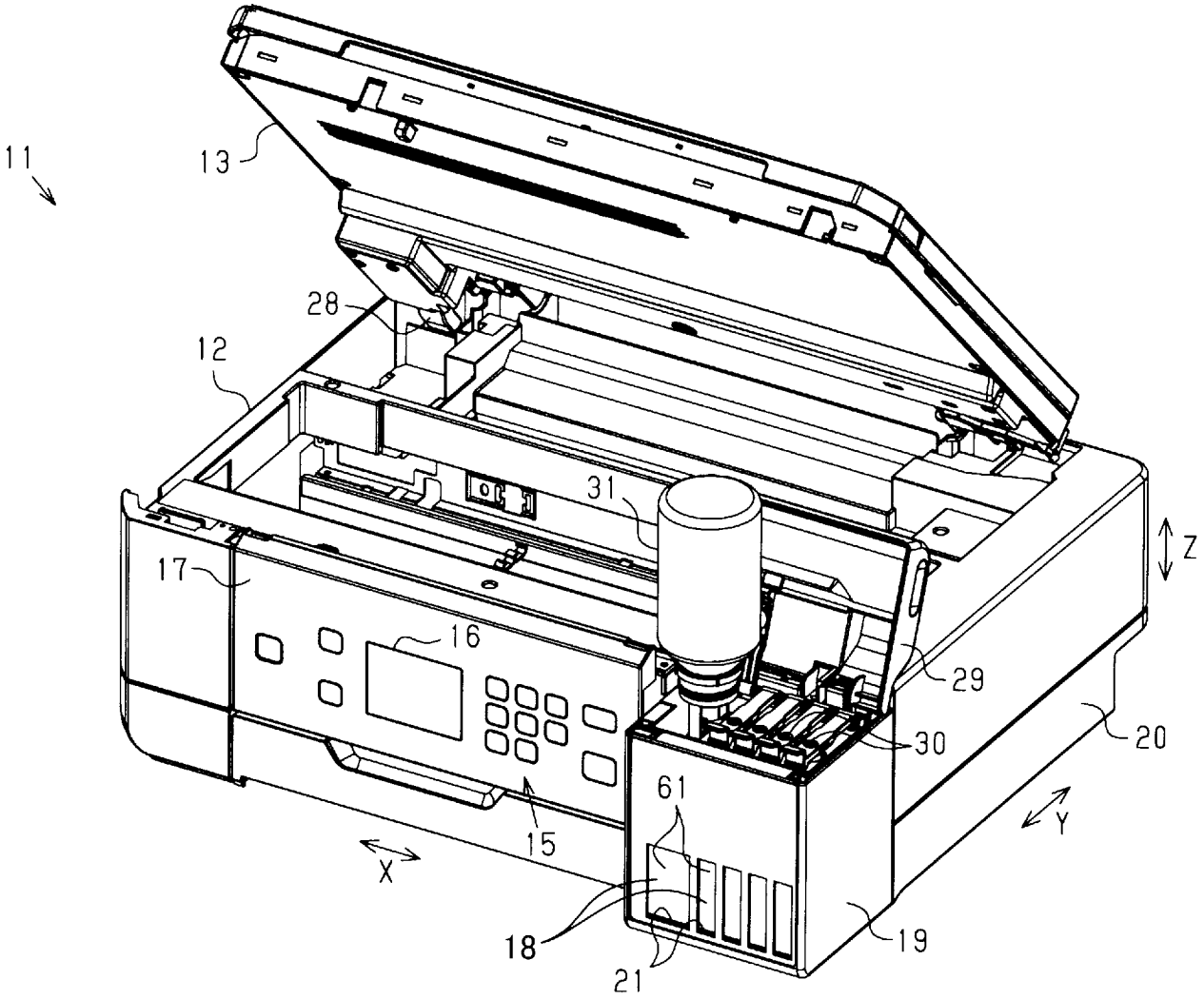
FIG. 2 is a perspective view illustrating a state where ink is supplied to an ink tank of the multifunction machine.

FIG. 1 is a perspective view of a multifunction machine 11 provided with a printer 12 according to a first embodiment. FIG. 2 is a perspective view illustrating a state where ink is supplied to an ink tank 18 of the multifunction machine 11. The multifunction machine 11 includes the printer 12 and an image reading device 13. The image reading device 13 is disposed on the printer 12 and covers an upper side of the printer 12. The multifunction machine 11 has a substantially rectangular parallelepiped shape on the whole.

In the present embodiment, the direction opposite to gravity is referred to as the upward direction, and the direction of gravity is referred to as the downward direction. Then, assuming that the multifunction machine 11 is placed on a horizontal surface in a use state, a direction along the upward and downward directions is illustrated as a vertical direction Z, and directions along the horizontal surface are illustrated as a width direction X and a depth direction Y. The width direction X, the depth direction Y, and the vertical direction Z are perpendicular to each other. One end in the depth direction Y may also be referred to as the front surface side or the front side, the other end opposite to the one end may also be referred to as the rear surface side or the rear side, and one end side in the width direction X seen from the front side may also be referred to as the right side, and the other end side may also be referred to as the left side.

The printer 12 prints characters and images on a medium by ejecting ink to a medium such as paper. The printer 12 includes a casing 20. An operation panel 17 and a tank unit 19 are provided on a front surface side of the casing 20. The operation panel 17 has an operation unit 15 and a display unit 16. The operation unit 15 includes buttons for performing various operations of the multifunction machine 11. The display unit 16 displays various types of information of the printer 12 and the multifunction machine 11. The operation panel 17 and the display unit 16 may be integrally formed as a touch panel.

The tank unit 19 houses at least one ink tank 18 therein. In the present embodiment, the tank unit 19 houses five ink tanks 18. At a front surface 99 of the tank unit 19, at least one window 21 is formed at a position corresponding to each of the ink tanks 18. In the present embodiment, five windows 21 are formed. In the present embodiment, each of the windows 21 is formed as a through hole penetrating the casing 20.

From the window 21, it is possible to view an ink viewing portion 61 provided in the ink tank 18. The ink viewing portion 61 is a portion of a wall that forms the ink tank 18 and is a portion where the ink in the ink tank 18 can be viewed from the outside. The ink viewing portion 61 includes an upper limit mark 63 that is a guide for an upper limit of an ink amount in the ink tank 18. In the present embodiment, the ink viewing portion 61 includes a lower limit mark 62 in addition to the upper limit mark 63. As illustrated in FIG. 1, one or more graduations 89 may be provided between the lower limit mark 62 and the upper limit mark 63. When a plurality of graduations 89 are provided, it is preferable to provide the graduations 89 at equal intervals including the upper limit mark 63 and the lower limit mark 62. Further, in the drawings in FIG. 2 and the subsequent figures, all or some of the upper limit mark 63, the lower limit mark 62, and the graduations 89 may be omitted.

A printing unit 23 that prints by depositing ink on a medium is housed in the casing 20. The printing unit 23 includes a supply unit 24, an ink ejecting head 25, and a carriage 26. The supply unit 24 has a tube for supplying ink housed in the ink tank 18 to the printing unit 23. The ink ejecting head 25 ejects the ink supplied from the ink tank 18 through the supply unit 24 from nozzles provided on a lower surface of the ink ejecting head 25. The carriage 26 reciprocates along the width direction X while holding the ink ejecting head 25. In this way, the ink tank 18 communicates with the ink ejecting head 25, and the printing unit 23 performs printing on the medium by ejecting ink, which is supplied from the ink tank 18 through the supply unit 24, from the ink ejecting head 25, which moves, toward the medium. Further, in the present embodiment, the supply unit 24 is provided in a plurality such that the supply units 24 correspond to the respective ink tanks 18, but one is illustrated in FIG. 1 for simplification of the drawing.

As illustrated in FIG. 2, the image reading device 13 is attached to the casing 20 via a pivot mechanism 28, such as a hinge, provided on the rear surface side of the casing 20. The image reading device 13 can be opened and closed with respect to the printer 12, and pivots between the closed position illustrated in FIG. 1 and the open position illustrated in FIG. 2. When the image reading device 13 is positioned at the open position, a cover 29 of the tank unit 19 and a cap 30 attached to the ink tank 18 can be opened and closed.

When the ink is supplied or resupplied to the ink tank 18, as illustrated in FIG. 2, the image reading device 13, the cover 29, and the cap 30 are positioned at the open position, and an ink supply container 31 that houses the ink for supply is coupled to the ink tank 18. Further, "ink is supplied" or "ink is resupplied" includes supplying ink from the ink supply container 31 to the ink tank 18, which is empty, for the first time, supplying ink when the ink in the ink tank 18 reaches the lower limit mark 62, and adding ink halfway even if the remaining amount of ink in the ink tank 18 is higher than the lower limit mark 62. In addition, "ink is supplied" or "ink is resupplied" does not necessarily include ink having to be supplied up to the upper limit mark 63 of the ink tank 18, and includes simply increasing the remaining amount of ink in the ink tank 18.

Figure 3:
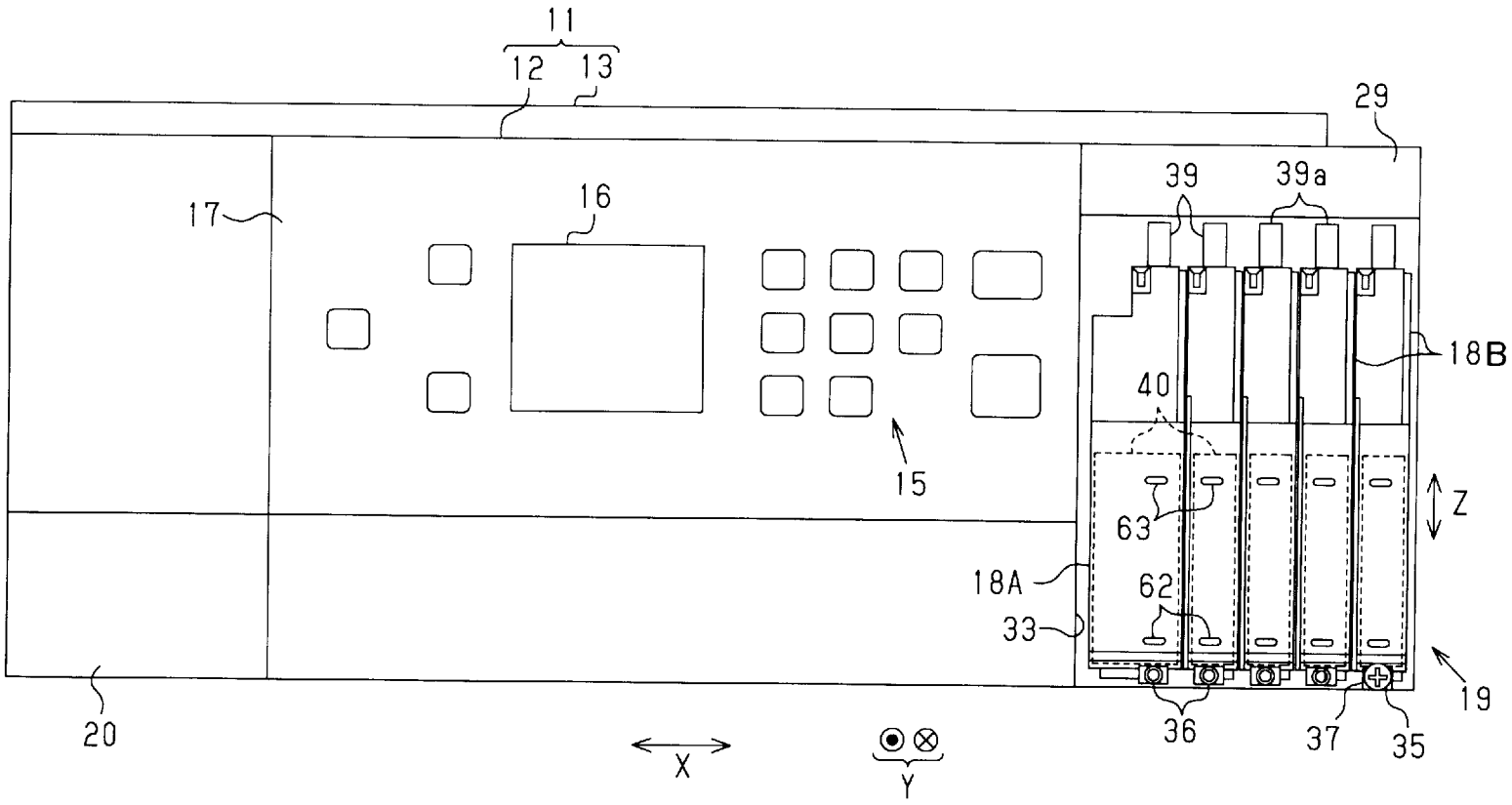
FIG. 3 is a front view of the multifunction machine.

FIG. 3 is a front view of the multifunction machine 11. In FIG. 3, the front surface 99 of the tank unit 19 is not illustrated. The tank unit 19 includes an attachment portion 33 to which the ink tank 18 can be attached. A first ink tank 18A and second ink tanks 18B, which are different in terms of the amount of ink that can be housed, are attached to the attachment portion 33 side by side in the width direction X. Each of the ink tanks 18 houses ink of a different color or type.

In the present embodiment, one first ink tank 18A for black ink having a large storage capacity is provided on the operation panel 17 side of the attachment portion 33. On the other side, four second ink tanks 18B for color ink, which have a smaller capacity than the first ink tank 18A, are provided. The configurations of the plurality of second ink tanks 18B are the same. In the following description, the same reference signs are given to configurations common to the first ink tank 18A and the second ink tanks 18B, and duplicate explanations are omitted. In the present specification, the first ink tank 18A and the second ink tank 18B are simply referred to as the ink tank 18 when they are referred to without distinction. Although the structure of the second ink tank 18B will be described below as the structure of the ink tank 18, the structure of the first ink tank 18A is also substantially the same as the structure of the second ink tank 18B except for the size in the width direction X.

Figure 4:
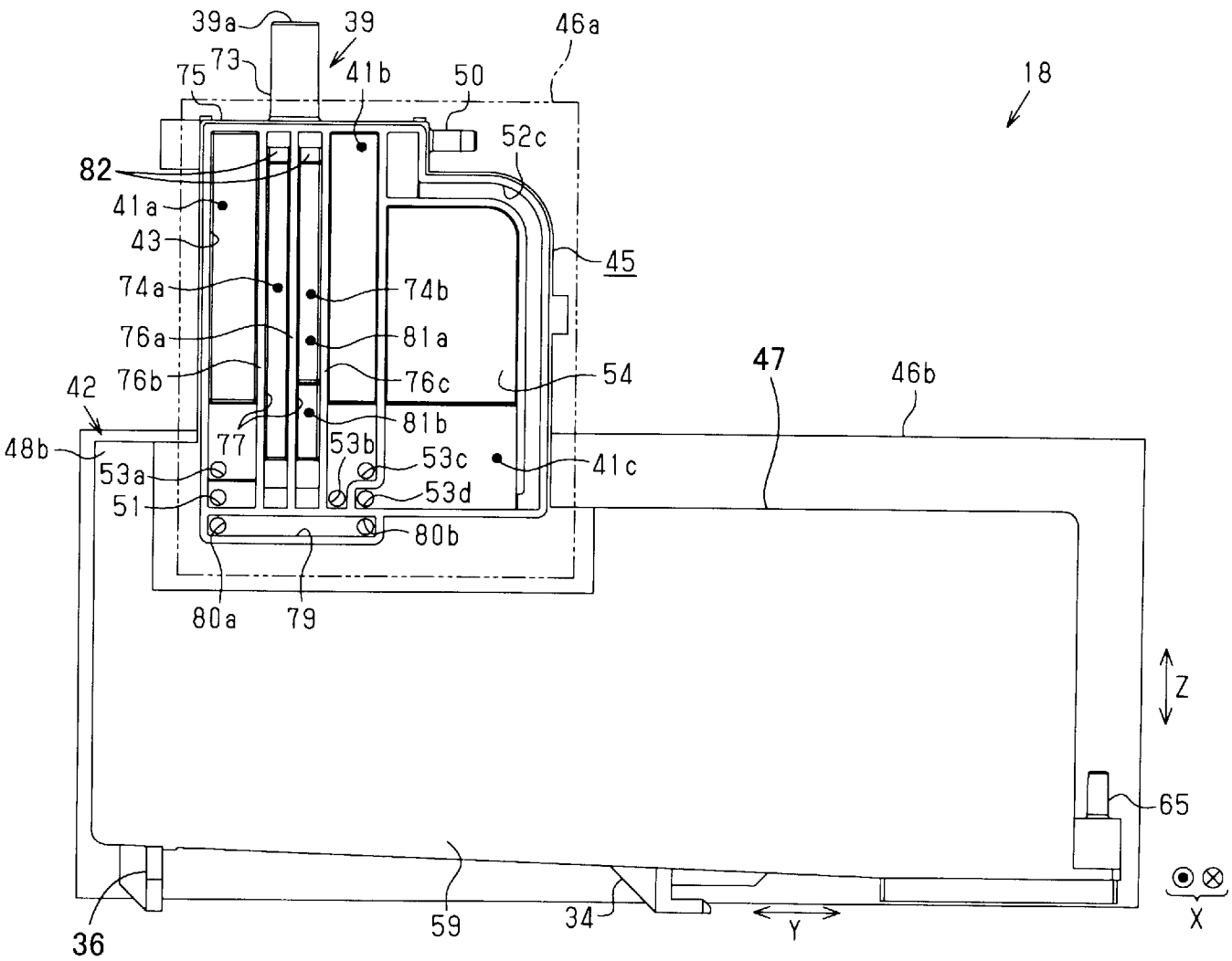
FIG. 4 is a right side view of the ink tank.
Figure 5:
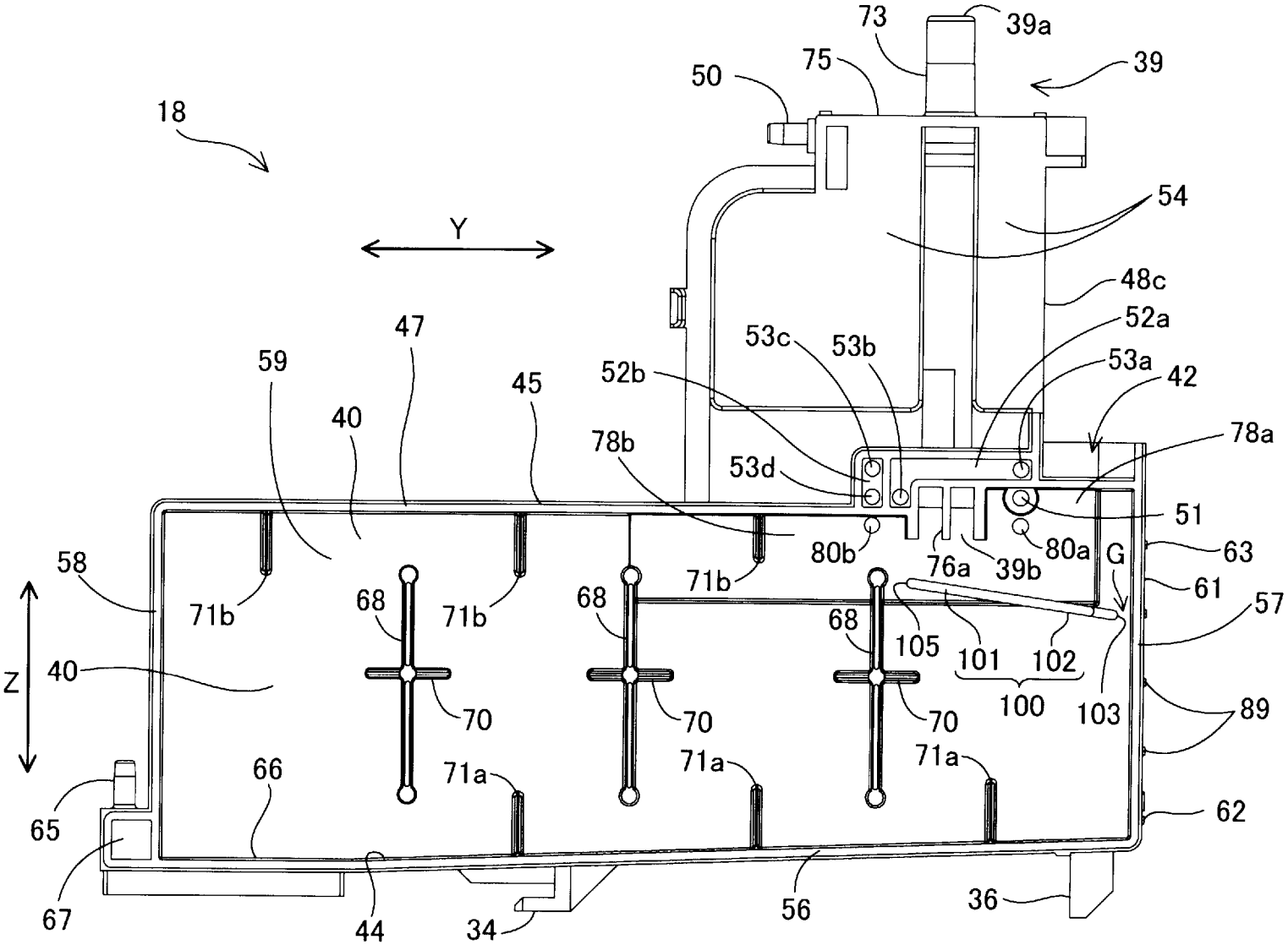
FIG. 5 is a left side view of the ink tank.
Figure 6:
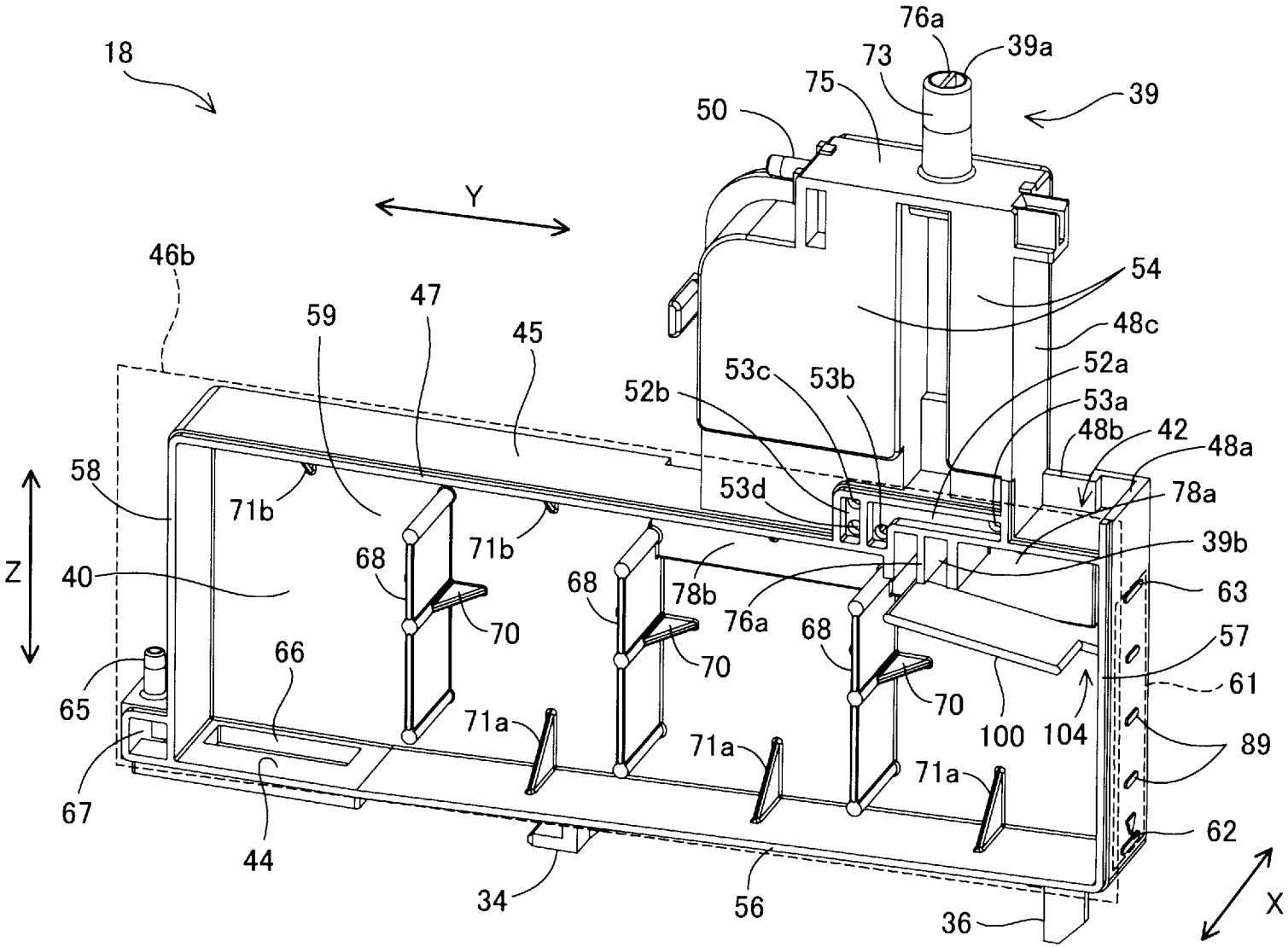
FIG. 6 is a perspective view of the ink tank as viewed from the left side.

FIG. 4 is a right side view of the ink tank 18. FIG. 5 is a left side view of the ink tank 18. FIG. 6 is a perspective view of the ink tank 18 as viewed from the left side. The ink tank 18 is formed with a claw portion 34 that engages with the attachment portion 33 illustrated in FIG. 3 and a screwing portion 36 into which an attachment screw 35 illustrated in FIG. 3 is screwed. A locking portion 37 for locking the attachment screw 35 is formed in the attachment portion 33. One locking portion 37 is illustrated in FIG. 3. In a state where the claw portion 34 is engaged with the attachment portion 33, the ink tank 18 is fixed to the attachment portion 33 by being screwed into the screwing portion 36 while the attachment screw 35 is locked to the locking portion 37. In the present embodiment, the state in which the ink tank 18 is fixed to the attachment portion 33 is referred to as the use state of the ink tank 18.

The ink tank 18 includes an ink chamber 40 capable of housing ink and an ink inlet portion 39. The ink inlet portion 39 extends in the vertical direction Z. The ink inlet portion 39 has an upper end 39*a* opening to the outside of the ink chamber 40 and a lower end 39*b* opening to the inside of the ink chamber 40. The ink inlet portion 39 communicates with the ink chamber 40 and receives a supply of ink from the ink supply container 31 illustrated in FIG. 2. In a state where the ink tank 18 is fixed to the attachment portion 33, the upper end 39*a* of the ink inlet portion 39 is located above the operation unit 15 and the display unit 16 as illustrated in FIG. 3.

The ink tank 18 is provided with a container case 45. Three buffer recessed portions 43, the right side of which is exposed, and a housing chamber recessed portion 44, the left side of which is exposed, are formed in the container case 45. The ink tank 18 includes the ink chamber 40 capable of housing ink to be supplied to the ink ejecting head 25 and a first buffer chamber 41*a*, a second buffer chamber 41*b*, and a third buffer chamber 41*c* provided above the ink chamber 40. The buffer chambers 41*a* to 41*c* are chambers into which ink can temporarily flow in order to suppress leakage of ink from the ink chamber 40. The buffer chambers 41*a* to 41*c* are formed by sealing the buffer recessed portions 43 with a first film 46*a*, which is an example of a film. The ink chamber 40 is formed such that the housing chamber recessed portion 44 is sealed by a second film 46*b*, which is an example of a film.

The first buffer chamber 41*a* is provided on the front side of the ink inlet portion 39. The second buffer chamber 41*b* and the third buffer chamber 41*c* are provided on the rear side of the ink inlet portion 39. The first buffer chamber 41*a* and the second buffer chamber 41*b* interpose the ink inlet portion 39 in the depth direction Y, and are provided along the direction in which the ink inlet portion 39 extends. The ink tank 18 includes an air communication portion 50 that enables the third buffer chamber 41*c* to communicate with the atmosphere.

The ink tank 18 includes a communication portion 51 that enables a lower end of the first buffer chamber 41*a* to communicate with an upper end of the ink chamber 40, and a first connection portion 52*a*, a second connection portion 52*b*, and a third connection portion 52*c* that couple the buffer chambers 41*a* to 41*c* so as to communicate with each other. The communication portion 51 communicates with the ink chamber 40 at a position above the lower end 39*b* of the ink inlet portion 39.

The first connection portion 52*a* couples the first buffer chamber 41*a* and the second buffer chamber 41*b* to each other. Specifically, the first connection portion 52*a* couples a first through hole 53*a* formed above the communication portion 51 in a lower portion of the first buffer chamber 41*a* and a second through hole 53*b* formed in a lower end of the second buffer chamber 41*b* to each other. The second connection portion 52*b* couples the second buffer chamber 41*b* and the third buffer chamber 41*c* to each other. Specifically, the second connection portion 52*b* couples a third through hole 53*c* formed above the second through hole 53*b* in a lower portion of the second buffer chamber 41*b* and a fourth through hole 53*d* formed in a lower end of the third buffer chamber 41*c* to each other. The third connection portion 52*c* couples the third buffer chamber 41*c* and the air communication portion 50 to each other.

The through holes 53*a* to 53*d* are formed so as to penetrate a left wall 54 that defines the buffer chambers 41*a* to 41*c*. The first connection portion 52*a* and the second connection portion 52*b* are provided on the outer surface of the left wall 54, and are formed by a groove opening toward the left and the second film 46*b* that seals the groove. The third connection portion 52*c* is formed of a groove opening toward the right in a peripheral portion of the container case 45, and the first film 46*a* that seals the groove.

The ink chamber 40 communicates with the air communication portion 50 via the communication portion 51, the first buffer chamber 41*a*, the first connection portion 52*a*, the second buffer chamber 41*b*, the second connection portion 52*b*, the third buffer chamber 41*c*, and the third connection portion 52*c* described above.

The ink tank 18 includes a storage portion 42. The storage portion 42 is located below the upper end 39*a* of the ink inlet portion 39 and stores ink that has flowed down from the upper end 39*a* to the outside of the ink inlet portion 39. The storage portion 42 is defined by a top wall 47, which defines the ink chamber 40, a first storage portion wall 48*a*, a second storage portion wall 48*b*, and a third storage portion wall 48*c* that stand upright from the top wall 47 and are open on the left side, and the second film 46*b* that seals the opening on the left of the storage portion walls 48*a* to 48*c*, and is formed so as to open upward. That is, the storage portion walls 48*a* to 48*c* are formed of the first storage portion wall 48*a* located forward, the second storage portion wall 48*b* located rightward, and the third storage portion wall 48*c* located rearward. The third storage portion wall 48*c* divides the storage portion 42 and the first buffer chamber 41*a*.

The ink chamber 40 is defined by the top wall 47, a bottom wall 56 opposite to the top wall 47 in the vertical direction Z, a front wall 57 intersecting the top wall 47 and the bottom wall 56, a rear wall 58, a right wall 59, and the second film 46*b*. The right wall 59 and the second film 46*b* form side walls of the ink chamber 40. The front wall 57, the rear wall 58, and the side walls are provided so as to extend in a direction intersecting the top wall 47, and stand upright in the vertical direction Z. The top wall 47 defines the ink chamber 40 and the buffer chambers 41*a* to 41*c*. A portion of the right wall 59 and the front wall 57 are formed extending upward from the ink chamber 40, and the portion above the top wall 47 forms the first storage portion wall 48*a* and the second storage portion wall 48*b*. Further, in the present specification, the case of two walls or surfaces being "opposite" includes the case in which two walls or surfaces face each other in the absence of another object between the two walls or surfaces and the case in which two walls or surfaces face each other with an object between the two walls or surfaces. In addition, that two walls or surfaces "intersect" indicates that the two walls or surfaces are not parallel to each other. Apart from when two walls or surfaces are in direct contact with each other, even in a positional relationship in which they are not in direct contact with each other but are separated from each other, they can also be said to intersect when the extension of one wall or surface and the extension of the other wall or surface intersect. The angle formed by two intersecting walls or surfaces may be any of a right angle, an obtuse angle, and an acute angle.

The container case 45 forming the ink tank 18 is made of a transparent or translucent resin, and the liquid level of the ink housed in the ink chamber 40 can be viewed from the outside. In the front wall 57, a region corresponding to the window 21 illustrated in FIG. 1 functions as the ink viewing portion 61 through which ink in the ink chamber 40 can be viewed from the outside. That is, the ink tank 18 includes the ink viewing portion 61 that is a portion of a wall that defines the ink chamber 40 and through which the ink in the ink chamber 40 can be viewed from the outside. The ink viewing portion 61 extends in the vertical direction Z. The ink inlet portion 39 is located above the ink viewing portion 61. The ink viewing portion 61 is provided with the upper limit mark 63, the lower limit mark 62, and the graduation 89. The inner surface of the front wall 57 on the ink chamber 40 side is preferably subjected to hydrophobic treatment. For example, hydrophobic treatment can be performed by applying a silicon-based water repellent to the inner surface of the front wall 57. As a result, the ink attached to the front wall 57 is easily drawn, and the liquid level of the ink housed in the ink chamber 40 is easily viewed.

In a lower portion of the rear wall 58, an ink lead-out portion 65 coupled to the supply unit 24 illustrated in FIG. 1 and from which ink is drawn out to the printing unit 23 is provided facing upward. The bottom wall 56 is formed inclined so as to become higher toward the front wall 57 side in the depth direction Y. In the bottom wall 56, a filter attachment portion 66, which has a recessed shape, is formed at a position on the rear wall 58 side where the slope is low. A filter (not illustrated) is attached to the filter attachment portion 66 by heat welding or the like. The ink tank 18 includes an ink lead-out channel 67 that couples the filter attachment portion 66 and the ink lead-out portion 65 to each other. The ink housed in the ink chamber 40, when ink of the ink ejecting head 25 has been consumed, is supplied to the printing unit 23 through the filter of the filter attachment portion 66 via the ink lead-out channel 67, the ink lead-out portion 65, and the supply unit 24.

At least one vertical rib portion 68 is formed in the ink chamber 40. The vertical rib portion 68 is formed so as to be spaced apart from the top wall 47 and the bottom wall 56 in the vertical direction Z. On the front and rear sides of the vertical rib portion 68, an extension 70 having a substantially right-angle-triangle shape in top view is formed perpendicular to the right wall 59 such that the width along the depth direction Y gradually increases from the opening side of the housing chamber recessed portion 44 toward the right wall 59 side. The width of the vertical rib portion 68 in the width direction X is substantially equal to the width of the housing chamber recessed portion 44. Therefore, when the second film 46*b* is adhered to the housing chamber recessed portion 44, the second film 46*b* is adhered also to the end surface of the left end of the vertical rib portion 68.

Furthermore, a first protrusion 71*a* that protrudes upward from the bottom wall 56 is formed in the ink chamber 40. In addition, a second protrusion 71*b* that protrudes downward from the top wall 47 is formed in the ink chamber 40. The first protrusion 71*a* and the second protrusion 71*b* have a substantially right-angle-triangle shape in front view such that the width along the vertical direction Z gradually narrows from the right wall 59 toward the opening side of the housing chamber recessed portion 44.

The lower end 39*b* of the ink inlet portion 39 is located in the upper space of the ink chamber 40, and protrudes downward from the top wall 47 that defines the ink chamber 40. When the ink tank 18 is in use, the upper end 39*a* of the ink inlet portion 39 is located above the lower end 39*b*. The upper end 39*a* is located above the top wall 47 and the lower end 39*b* is located below the top wall 47. The upper space of the ink chamber 40 is a space above the center of the ink chamber 40 and is a space above at least one of the upper end of the vertical rib portion 68 and the lower end of the second protrusion 71*b*.

The ink inlet portion 39 includes a cylinder portion 73 provided along the vertical direction Z. The cylinder portion 73 is provided so as to protrude upward from an upper surface 75 of the ink tank 18 that intersects the third storage portion wall 48*c*. The tip/upper end of the cylinder portion 73 of the ink inlet portion 39 is the upper end 39*a*. The ink inlet portion 39 has a first ink flow channel 74*a* and a second ink flow channel 74*b* coupling the upper end 39*a* and the lower end 39*b* to each other.

The lower end 39*b* of the first ink flow channel 74*a* and the lower end 39*b* of the second ink flow channel 74*b*, which are also the lower end 39*b* of the ink inlet portion 39, are located at the same height in the ink chamber 40. In addition, the lower end 39*b* is located at a position corresponding to the upper limit mark 63 in the vertical direction Z. Specifically, the lower end 39*b* is located at the same height as the upper limit mark 63 or in the vicinity of the upper limit mark 63 in the vertical direction Z.

A first flow channel wall 76*a* extending in the width direction X and the vertical direction Z is provided at a central position in the depth direction Y in the cylinder portion 73 forming the ink inlet portion 39. The first flow channel wall 76*a* divides the first ink flow channel 74*a* and the second ink flow channel 74*b*. The first flow channel wall 76*a* is provided continuously from the upper end 39*a* to the lower end 39*b*. The first ink flow channel 74*a* and the second ink flow channel 74*b* have substantially the same sectional area in the horizontal direction in the cylinder portion 73.

A second flow channel wall 76*b* that divides the first buffer chamber 41*a* and the ink inlet portion 39 is provided at a position on the front side of the first flow channel wall 76*a* in the depth direction Y. In addition, a third flow channel wall 76*c* is provided at a position on the rear side of the first flow channel wall 76*a* in the depth direction Y, the third flow channel wall 76*c* dividing the second buffer chamber 41*b* and the ink inlet portion 39. In the present embodiment, two grooves 77 coupled from the cylinder portion 73 are defined in the depth direction Y by the first flow channel wall 76*a*, the second flow channel wall 76*b*, and the third flow channel wall 76*c*.

The grooves 77 are formed by sealing with the first film 46*a* and the second film 46*b* between the cylinder portion 73 and the lower end 39*b* of the ink inlet portion 39. Specifically, the grooves 77 have portions open on both sides in the width direction X, respectively. Then, the first film 46*a* seals a portion of the grooves 77, which is a portion formed between the first buffer chamber 41*a* and the second buffer chamber 41*b*, to form a space between the cylinder portion 73 and the lower end 39*b* of the ink inlet portion 39. In addition, the second film 46*b* seals a portion of the grooves 77, which is a portion formed in the housing chamber recessed portion 44, to form the lower end 39*b* of the ink inlet portion 39.

When the ink tank 18 is in use, the space above the lower end 39*b* of the ink chamber 40 is divided by the ink inlet portion 39 into a first upper space 78*a* on the front side and a second upper space 78*b* on the rear side. That is, in the ink chamber 40, the first upper space 78*a* and the second upper space 78*b* are provided with the lower end 39*b* of the ink inlet portion 39 interposed therebetween.

As illustrated in FIG. 4, the ink tank 18 is provided with a communication channel 79 that enables the first upper space 78*a* to communicate with the second upper space 78*b*. The communication channel 79 enables a first communication hole 80*a* formed so as to penetrate the right wall 59 of the ink chamber 40 to communicate with a second communication hole 80*b*. The communication channel 79 is formed in the right wall 59, and is formed by a groove that opens toward the right and the first film 46*a* that seals the groove. The first communication hole 80*a* opens to the first upper space 78*a* to which the communication portion 51 opens, and the second communication hole 80*b* opens to the second upper space 78*b* located opposite to the first upper space 78*a* with the lower end 39*b* of the ink inlet portion 39 interposed therebetween.

When the ink tank 18 is in use, the volume of the space above the lower end 39*b* of the ink inlet portion 39 in the ink chamber 40 is larger than the volume of the ink inlet portion 39. That is, the sum of the volumes of the first upper space 78*a* and the second upper space 78*b* is larger than the sum of the volumes of the first ink flow channel 74*a* and the second ink flow channel 74*b*.

Figure 7:
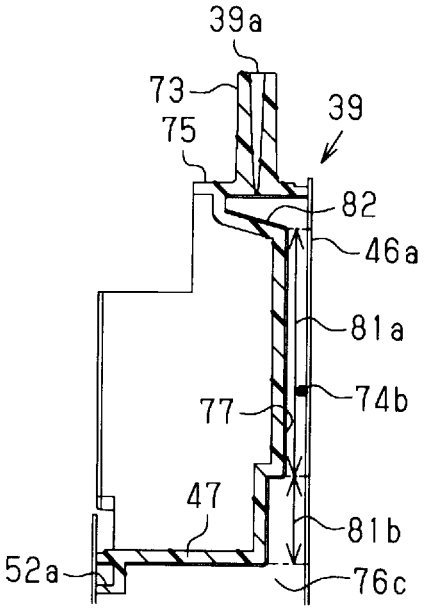
FIG. 7 is an XZ sectional view in the vicinity of a second ink flow channel.
Figure 8:
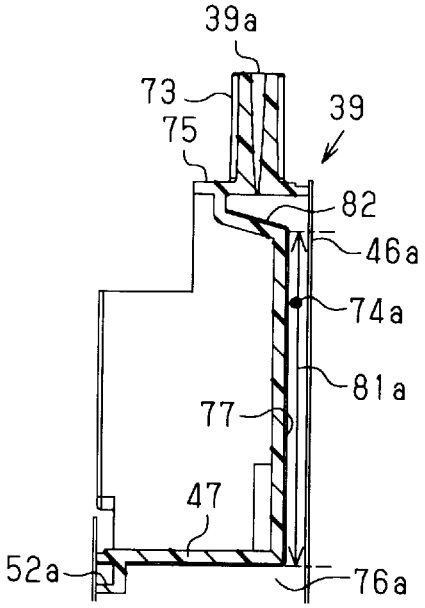
FIG. 8 is an XZ sectional view in the vicinity of a first ink flow channel.

FIG. 7 is an XZ sectional view in the vicinity of the second ink flow channel 74*b*. FIG. 8 is an XZ sectional view in the vicinity of the first ink flow channel 74*a*. As illustrated in FIG. 7, the second ink flow channel 74*b* has a first flow channel portion 81*a* and a second flow channel portion 81*b* having a sectional area larger than the first flow channel portion 81*a* in the horizontal direction. In the present embodiment, the depths of the grooves 77 of the first flow channel portion 81*a* and the second flow channel portion 81*b* are different, and the depth of the groove 77 of the second flow channel portion 81*b* is larger than the depth of the groove 77 of the first flow channel portion 81*a*. In addition, in the vertical direction Z, the first flow channel portion 81*a* is located above the second flow channel portion 81*b*, and the length of the first flow channel portion 81*a* is larger than the length of the second flow channel portion 81*b*. On the other hand, as illustrated in FIG. 8, the first ink flow channel 74*a* is configured such that portions of the groove 77 corresponding to the first flow channel portion 81*a* and the second flow channel portion 81*b* of the second ink flow channel 74*b* have the same depth. In the second ink flow channel 74*b*, the portion of which the sectional area in the horizontal direction at the same position in the vertical direction Z becomes different from that of the first ink flow channel 74*a* is the second flow channel portion 81*b*.

As illustrated in FIGS. 7 and 8, in the first ink flow channel 74*a* and the second ink flow channel 74*b*, the horizontal-direction sectional area of an upper portion above the first flow channel portion 81*a* is formed, as an ink receiving portion 82, larger than the first flow channel portion 81*a*. The upper portion of the ink receiving portion 82 communicates with the cylinder portion 73. The bottom surface of the ink receiving portion 82 is formed inclined downward so that the ink can be easily drawn into the first flow channel portion 81*a* that is coupled to the ink receiving portion 82.

As illustrated in FIGS. 5 and 6, the ink chamber 40 has an ink guide wall 100. The ink guide wall 100 is a wall that guides the ink from the ink inlet portion 39 to the ink viewing portion 61 when the ink is supplied from the ink supply container 31. The ink guide wall 100 is formed substantially in a plate shape, and is erected from the right wall 59 toward the second film 46*b*. The second film 46*b* is adhered to the end surface of the left end of the ink guide wall 100.

The ink guide wall 100 is located between the lower end 39*b* of the ink inlet portion 39 and the bottom wall 56 in the vertical direction Z. The ink guide wall 100 has a first portion 101 facing the ink inlet portion 39 in the vertical direction Z, and a second portion 102 located between the first portion 101 and the ink viewing portion 61 in the horizontal direction. In the present embodiment, the ink guide wall 100 is inclined so as to become lower toward the ink viewing portion 61 on the whole such that the second portion 102 becomes lower than the first portion 101 in the vertical direction Z.

As illustrated in FIG. 5, the first portion 101 of the ink guide wall 100 has a rear end 105 facing the rear wall 58 in the depth direction Y. The rear end 105 is exposed in the ink chamber 40 and is not coupled to any other wall. The second portion 102 of the ink guide wall 100 has a viewing-portion-side end 103 facing the ink viewing portion 61 in the depth direction Y. In the present embodiment, as illustrated in FIG. 6, the second portion 102 is provided with a recessed portion 104, which is rectangular-notch-shaped, at a corner on the second film 46*b* side and the ink viewing portion 61 side. The recessed portion 104 has a shape in which a portion of the viewing-portion-side end 103 of the ink guide wall 100 is recessed toward the side opposite to the ink viewing portion 61. The width of the viewing-portion-side end 103 along the width direction X is smaller than the width of the first portion 101 due to the recessed portion 104. In addition, due to the recessed portion 104, a portion of the ink guide wall 100 will be spaced apart from a portion of the second film 46*b* as a side wall defining the ink chamber 40. The recessed portion 104 can also be referred to as a step portion. A gap G is formed between the viewing-portion-side end 103 and the ink viewing portion 61 in the depth direction Y. The length of the gap G in the depth direction Y is approximately 0.5 mm or more and 2.0 mm or less. Any length can be set in accordance with the flow rate of the ink on the upper surface of the ink guide wall 100.

Figure 9:
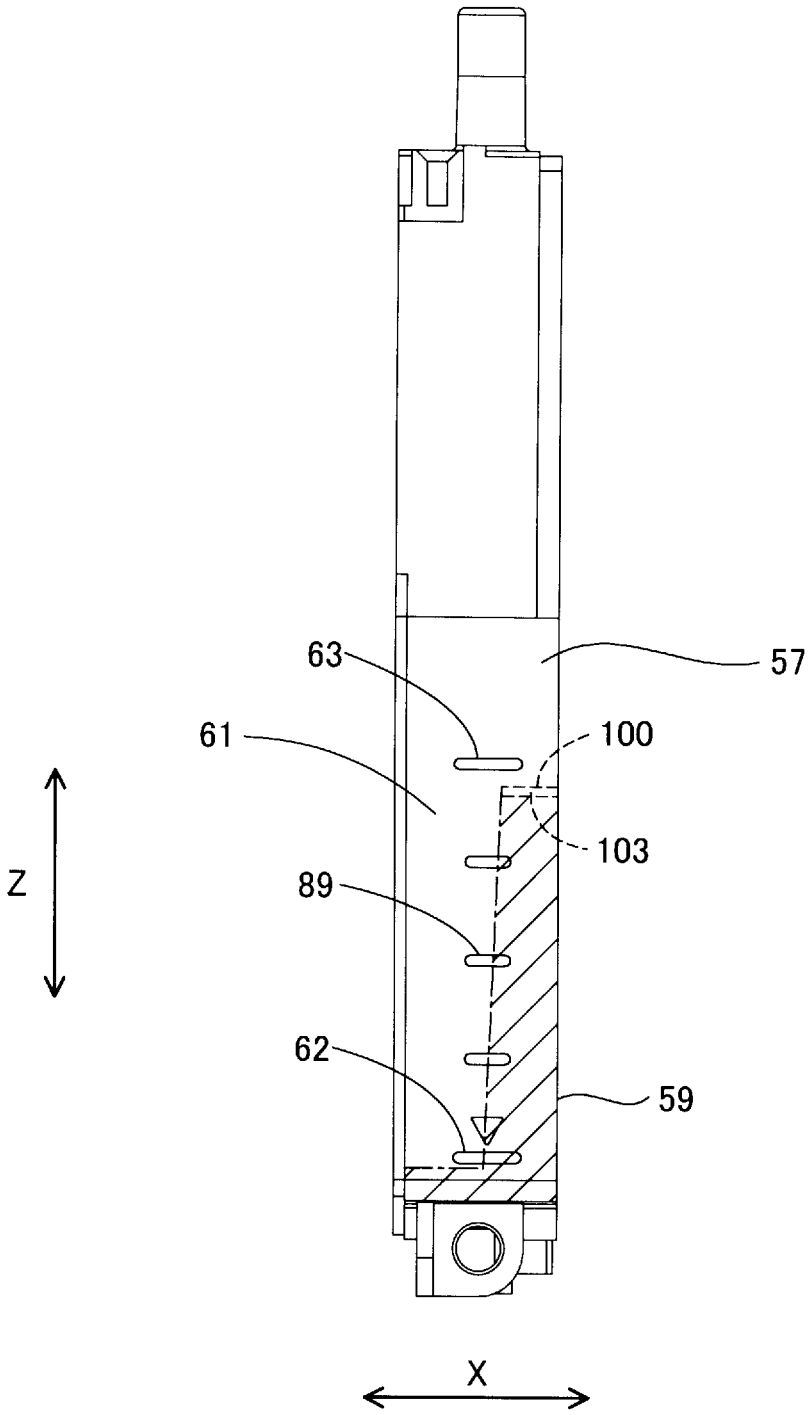
FIG. 9 is a view illustrating the position of a viewing-portion-side end.

FIG. 9 is a view illustrating the position of the viewing-portion-side end 103. In the present embodiment, the viewing-portion-side end 103 is at a position lower than the upper limit mark 63 provided in the ink viewing portion 61 in the vertical direction Z. The width of the viewing-portion-side end 103 along the width direction X is smaller than the width of the front wall 57 and smaller than the width of the ink viewing portion 61. In the present embodiment, the viewing-portion-side end 103 is formed closer to the right wall 59 side than to the center of the upper limit mark 63 in the width direction X. Further, the viewing-portion-side end 103 may be formed closer to the second film 46*b* side than to the center of the upper limit mark 63 in the width direction X.

In the present embodiment, as illustrated in FIGS. 2-8, when the ink supply container 31 is coupled to the cylinder portion 73 on the upper end 39*a* side of the ink inlet portion 39, the ink flows down the first ink flow channel 74*a* and the second ink flow channel 74*b* toward the ink chamber 40. Then, the air in the ink chamber 40 is pushed by the ink and the pressure increases. The ink flowing through the first ink flow channel 74*a* flows into the ink chamber 40. On the other hand, the ink flowing through the second ink flow channel 74*b* is pushed by the air pressure in the ink chamber 40 at an intermediate position of the second ink flow channel 74*b* and the descent stops. Then, the ink in the second ink flow channel 74*b* is pushed back to the ink supply container 31 by the air pressure in the ink chamber 40 into which the ink has flowed. For example, the ink flowing through the second ink flow channel 74*b* descends along the first flow channel portion 81*a* and stops falling at the boundary with the second flow channel portion 81*b* and is pushed back into the first flow channel portion 81*a*. As a result, the first ink flow channel 74*a* becomes a flow channel that causes the ink to flow from the ink supply container 31 into the ink chamber 40, and the second ink flow channel 74*b* becomes a flow channel that causes the air in the ink chamber 40 to flow into the ink supply container 31. That is, between the ink supply container 31 and the ink tank 18, the air in the ink chamber 40 flows into the ink supply container 31 in an amount equivalent to the amount of ink injected from the ink supply container 31 into the ink chamber 40, and a so-called gas-liquid exchange is performed.

When the ink flows from the first ink flow channel 74*a* into the ink chamber 40, the ink descends to the ink guide wall 100 and flows along the upper surface of the ink guide wall 100 to the ink viewing portion 61 side. The ink that has reached the recessed portion 104 formed in the second portion 102 of the ink guide wall 100 flows down toward the bottom wall 56 as is. On the other hand, the ink having reached the viewing-portion-side end 103 of the second portion 102 reaches the inner surface of the ink viewing portion 61 by the momentum of the flow, and flows downward while travelling along the inner surface of the ink viewing portion 61. In FIG. 9, hatching illustrates a state where ink flows downward along the inner surface of the ink viewing portion 61.

In this way, when the ink flows into the ink chamber 40 while passing along the inner surfaces of the ink guide wall 100 and the ink viewing portion 61, the height of the ink liquid surface rises up to the lower end 39*b* of the ink inlet portion 39 over the viewing-portion-side end 103. When the lower end 39*b* of the second ink flow channel 74*b* is blocked by the ink, the air does not flow into the ink supply container 31 via the second ink flow channel 74*b*. Then, the pressure applied to the liquid surface of the ink in the ink supply container 31 decreases, and the inflow of the ink from the ink supply container 31 to the ink chamber 40 stops. When the ink supply container 31 is removed from the ink inlet portion 39, the ink in the first ink flow channel 74*a* is subjected to atmospheric pressure. Therefore, the ink in the first ink flow channel 74*a* flows into the ink chamber 40, and the heights of the liquid levels of the ink in the ink inlet portion 39 and the ink chamber 40 become uniform. In the present embodiment, because the height of the upper limit mark 63 is near the height of the lower end 39*b* of the ink inlet portion 39, the liquid level of the ink exceeds the viewing-portion-side end 103 and becomes the height of the upper limit mark 63.

According to the ink tank 18 of the present embodiment described above, because the ink is guided from the ink inlet portion 39 to the ink viewing portion 61 by the ink guide wall 100, the user can easily view the start of ink supply. Therefore, the possibility of contamination of the periphery of the ink inlet portion 39 with ink due to, for example, the user spattering ink from the ink supply container 31 by forcibly squeezing the ink supply container 31 or removing the ink supply container 31 from the ink inlet portion 39 in suspicion of incorrect insertion of the ink supply container 31 is reduced.

In addition, according to the present embodiment, because the ink travels along the inner surface of the ink viewing portion 61 when the ink is supplied, the ink accumulated in the ink chamber 40 is unlikely to bubble. Therefore, air bubbles are less likely to be mixed in the ink supplied to the ink ejecting head 25 through the supply unit 24, and the printing stability is improved.

In addition, in the present embodiment, because the ink guide wall 100 includes the first portion 101 facing the ink inlet portion 39 in the vertical direction Z and the second portion 102 located between the first portion 101 and the ink viewing portion 61 in the horizontal direction, it is easy to guide the ink to the ink viewing portion 61.

In addition, in the present embodiment, the second portion 102 of the ink guide wall 100 includes the viewing-portion-side end 103 that faces the ink viewing portion 61, and the width of the viewing-portion-side end 103 is smaller than the width of the ink viewing portion 61. Therefore, it is possible to easily view the amount of ink rising from below through the portion of the ink viewing portion 61 that does not face the viewing-portion-side end 103 of the ink guide wall 100. Therefore, it can be easily recognized whether ink replenishment is being performed smoothly.

In addition, in the present embodiment, the ink viewing portion 61 is provided with the upper limit mark 63 that is a guide for the upper limit of the ink amount, and the viewing-portion-side end 103 is lower than the upper limit mark 63 in the vertical direction Z. Therefore, the ink that flows down from the viewing-portion-side end 103 and through the ink viewing portion 61 does not touch the upper limit mark 63. Therefore, it is easy to recognize when the ink amount has reached the upper limit.

In addition, in the present embodiment, because the second portion 102 of the ink guide wall 100 is lower than the first portion 101 in the vertical direction Z, it is easy to guide the ink supplied from the ink inlet portion 39 toward the ink viewing portion 61.

In addition, in the present embodiment, the rear end 105 of the ink guide wall 100 is not coupled to another wall in the ink chamber 40. Therefore, when the ink is supplied to the ink chamber 40 through the ink inlet portion 39, it is possible to suppress the rising air in the ink chamber 40 from being blocked by the ink guide wall 100.

In addition, in the present embodiment, the width of the viewing-portion-side end 103 along the width direction X is smaller than the width of the ink viewing portion 61, and the viewing-portion-side end 103 is formed sideward of the center of the upper limit mark 63 in the width direction X. Therefore, the wetting of the whole of the ink viewing portion 61 in the width direction is suppressed, the wetting being due to the ink flowing along the inner surface of the ink viewing portion 61 from the viewing-portion-side end 103. Therefore, it is easy to view the ink level.

In addition, in the present embodiment, by providing the recessed portion 104 in the ink guide wall 100, a space is provided between the ink guide wall 100 and a portion of the side wall of the ink tank 18. Therefore, the air below the ink guide wall 100 can easily escape to the upper side of the ink guide wall 100 through this space, and the ink can be supplied smoothly.

In addition, in the case of the ink tank 18 of the present embodiment, because the ink inlet portion 39 includes the plurality of ink flow channels 74*a* and 74*b*, at least one of the ink flow channels can be a flow channel that discharges air. Therefore, because the ink flow channel that causes the ink to flow into the ink chamber 40 and the flow channel that discharges the air from the ink chamber 40 can be divided, the ink can be stably supplied to the ink chamber 40.

In addition, for example, when the ink is caused to flow into the ink chamber 40, the pressure at which the ink pushes air in the plurality of ink flow channels 74*a* and 74*b* may balance with the pressure at which the air pushes the ink. Then, the ink may remain in the ink flow channels 74*a* and 74*b* and may not flow into the ink chamber 40. In this respect, in the present embodiment, the second ink flow channel 74*b* includes the first flow channel portion 81*a* having a small sectional area and the second flow channel portion 81*b* having a large sectional area. Therefore, the pressures of the air and ink can be made unbalanced. Therefore, the plurality of ink flow channels 74*a* and 74*b* can be easily divided into a flow channel through which air is discharged and a flow channel through which ink flows.

In addition, in the present embodiment, when ink is supplied to the ink chamber 40 and the ink level reaches the upper limit mark 63, the lower end 39*b* of the ink inlet portion 39 becomes blocked by the ink, and air does not enter the ink inlet portion 39 from the lower end 39*b*. Therefore, the supply of ink to the ink chamber 40 can be stopped at a position corresponding to the upper limit mark 63.

In addition, in the present embodiment, because the ink chamber 40 communicates with the atmosphere through the air communication portion 50 through the buffer chambers 41*a* to 41*c*, even when the air expands due to the influence of a temperature change or the like, pushes the ink surface, and the ink is pushed out of the ink chamber 40, the ink flows into the buffer chambers 41*a* to 41*c*. Therefore, even when the ink chamber 40 is filled with ink, the possibility that the ink is pushed out of the ink chamber 40 due to an environmental change can be reduced.

In addition, in the present embodiment, because the volume of the space above the ink chamber 40 is larger than the volume of the ink inlet portion 39, the possibility of the ink flowing into the first buffer chamber 41*a* can be reduced even if ink remaining in the ink inlet portion 39 flows into the ink chamber 40 after the supply of ink.

In addition, in the present embodiment, because the storage portion 42 is provided below the ink inlet portion 39, the ink leaking from the ink inlet portion 39 to the outside can be stored in the storage portion 42. Therefore, the possibility of the ink spreading around the ink tank 18 can be reduced. Further, the ink tank 18 need not have the storage portion 42.

B. Second Embodiment

Figure 10:
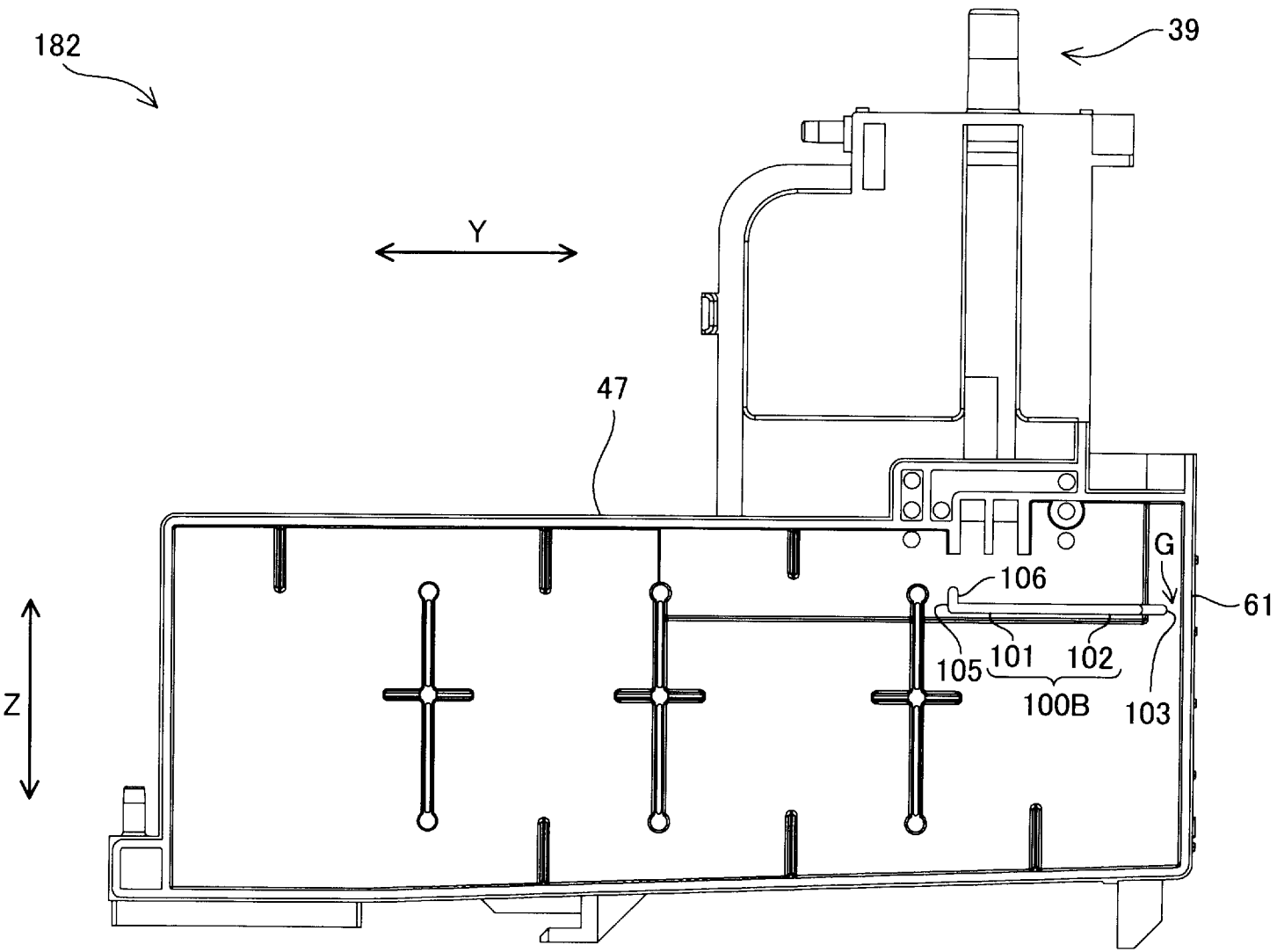
FIG. 10 is a left side view of an ink tank according to a second embodiment.
Figure 11:
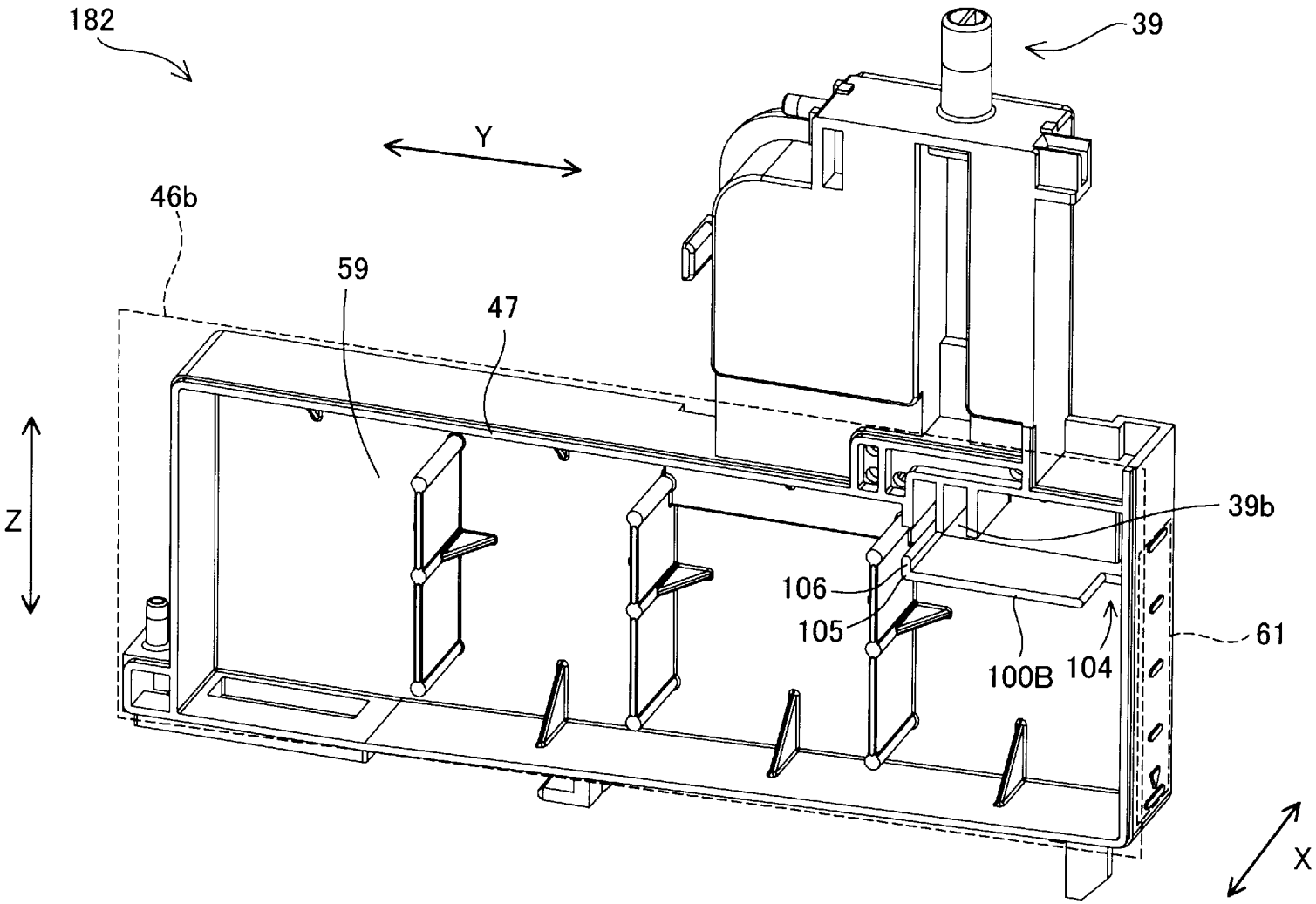
FIG. 11 is a perspective view of the ink tank according to the second embodiment as viewed from the left side.

FIG. 10 is a left side view of an ink tank 182 according to a second embodiment. FIG. 11 is a perspective view of the ink tank 182 according to the second embodiment as viewed from the left side. The ink tank 182 in the present embodiment differs from that in the first embodiment in terms of the shape of an ink guide wall 100B.

The ink guide wall 100B in the present embodiment, as in the first embodiment, includes the first portion 101 facing the ink inlet portion 39 in the vertical direction Z and the second portion 102 located between the first portion 101 and the ink viewing portion 61 in the horizontal direction.

However, in the present embodiment, the first portion 101 and the second portion 102 are not inclined but horizontal, and the first portion 101 and the second portion 102 have the same height in the vertical direction Z. Also in the present embodiment, the recessed portion 104 is formed in the second portion 102 as in the first embodiment. In the present embodiment, the ink guide wall 100B is provided at the rear end 105 of the first portion 101 with an upright wall portion 106 that stands upright. The width of the upright wall portion 106 in the width direction X is the same as that of the first portion 101. The height of the upright wall portion 106 is larger than the height of the viewing-portion-side end 103. The upper end of the upright wall portion 106 is separated from the ink inlet portion 39 and the top wall 47.

According to the ink tank 182 of the second embodiment described above, because the upright wall portion 106 is provided at the rear end 105 of the ink guide wall 100B, it is possible to make it difficult for the ink received from the ink inlet portion 39 to escape to the side opposite to the ink viewing portion 61 side. Therefore, it is easy to guide the ink toward the ink viewing portion 61. Therefore, as in the first embodiment, the user can easily view the start of ink supply. Further, the upright wall portion 106 may also be provided on the ink guide wall 100 of the first embodiment or the ink guide wall of each of embodiments described later.

C. Third Embodiment

Figure 12:
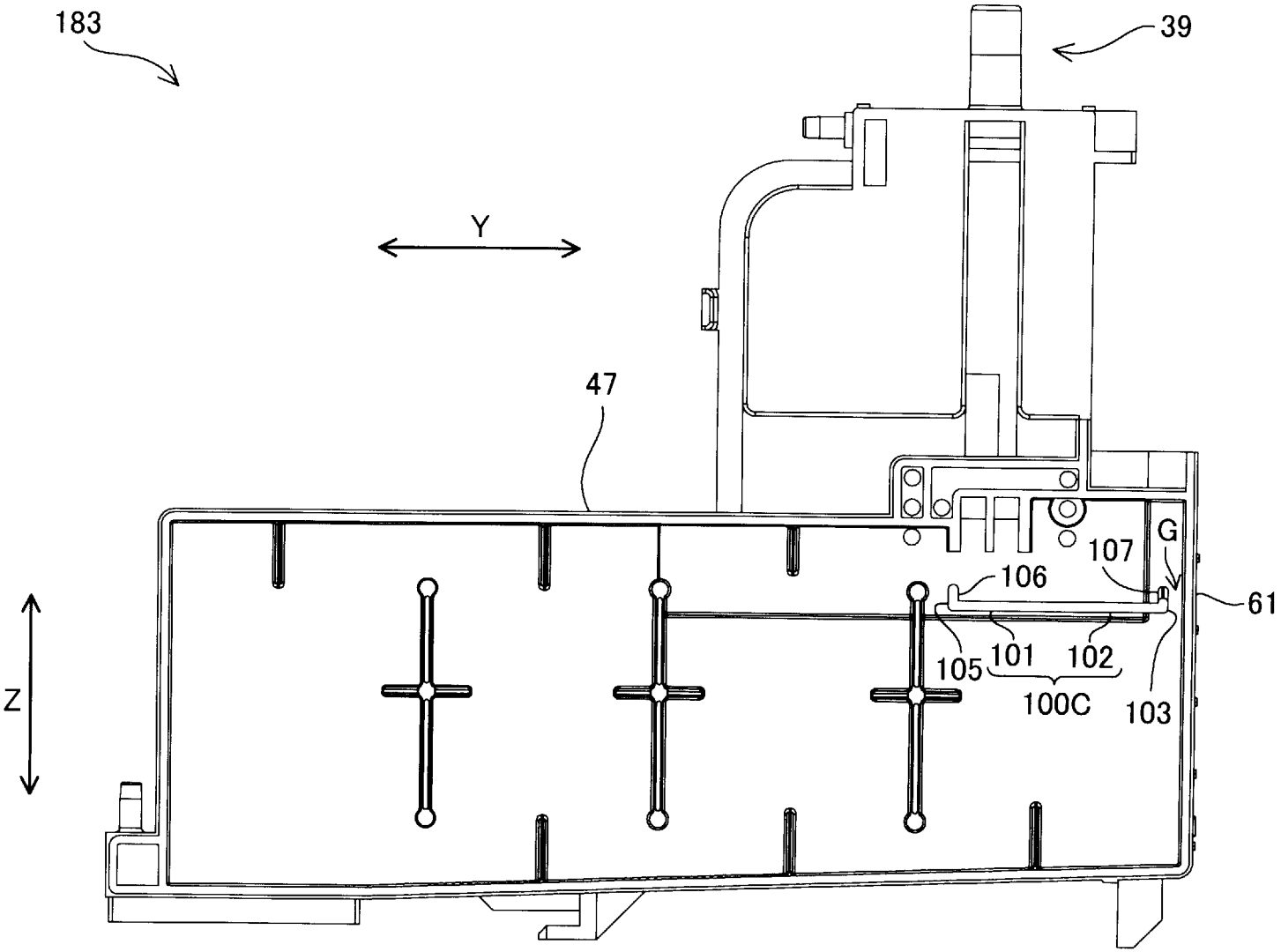
FIG. 12 is a left side view of an ink tank according to a third embodiment.
Figure 13:
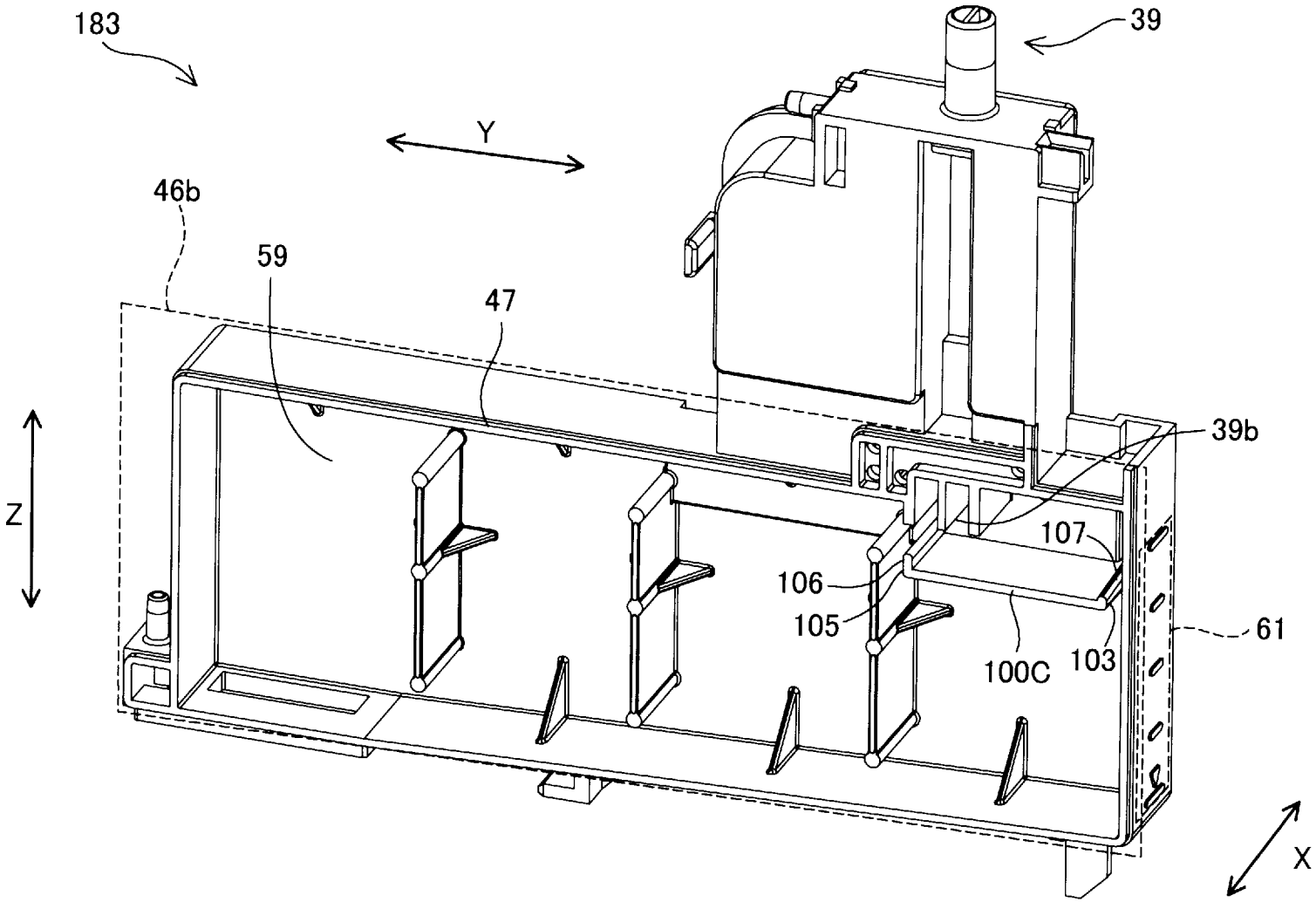
FIG. 13 is a perspective view of the ink tank according to the third embodiment as viewed from the left side.

FIG. 12 is a left side view of an ink tank 183 according to a third embodiment. FIG. 13 is a perspective view of the ink tank 183 according to the third embodiment as viewed from the left side. The ink tank 183 of the present embodiment differs from the first embodiment in terms of the shape of the ink guide wall 100.

An ink guide wall 100C of the present embodiment, as in the first embodiment, includes the first portion 101 facing the ink inlet portion 39 in the vertical direction Z and the second portion 102 located between the first portion 101 and the ink viewing portion 61 in the horizontal direction. As in the second embodiment, the first portion 101 and the second portion 102 are not inclined but horizontal, and the first portion 101 and the second portion 102 have the same height in the vertical direction Z. However, in the present embodiment, the recessed portion 104 is not formed in the second portion 102. Therefore, the width of the viewing-portion-side end 103 is equal to the width of the first portion 101. That is, the width of the viewing-portion-side end 103 is substantially the same as the width of the ink viewing portion 61.

In the present embodiment, as in the second embodiment, the ink guide wall 100C is provided at the rear end 105 of the first portion 101 with the upright wall portion 106 standing upright. Furthermore, in the present embodiment, the ink guide wall 100C is provided with a second upright wall portion 107 standing upright at the viewing-portion-side end 103 of the second portion 102. The upper end of the second upright wall portion 107 is inclined with respect to the horizontal direction. Specifically, in the present embodiment, the upper end of the second upright wall portion 107 is lower on the second film 46*b* side than on the right wall 59 side. The lowest height of the second upright wall portion 107 is lower than the height of the upright wall portion 106. Therefore, the ink flowing on the ink guide wall 100C flows from the vicinity of the lowest portion of the second upright wall portion 107 toward the ink viewing portion 61.

In the ink tank 183 according to the third embodiment described above, as in the first embodiment, because the ink is guided from the ink inlet portion 39 to the ink viewing portion 61 by the ink guide wall 100C, the user can easily view the start of ink supply.

D. Fourth Embodiment

Figure 14:
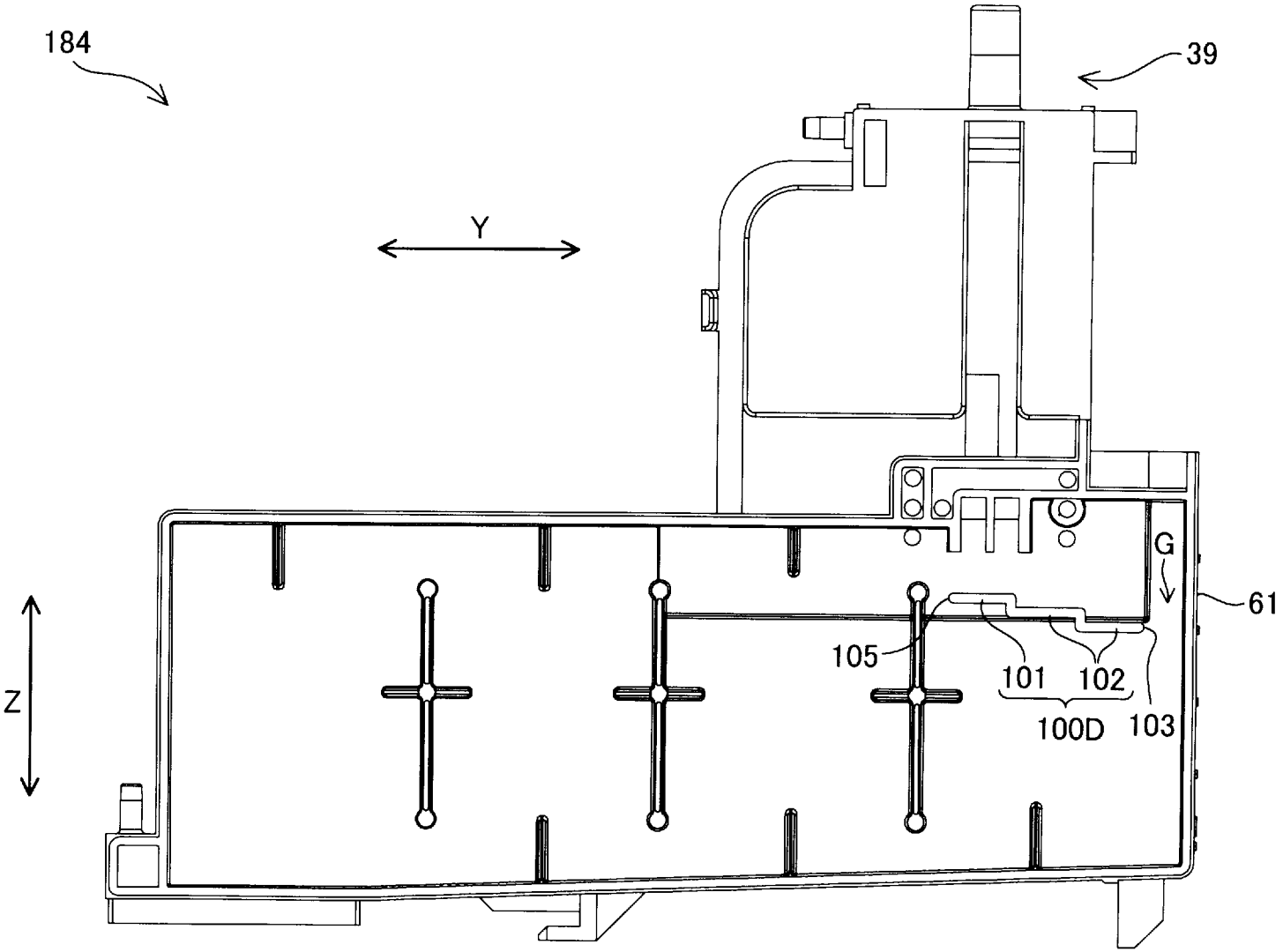
FIG. 14 is a left side view of an ink tank according to a fourth embodiment.
Figure 15:
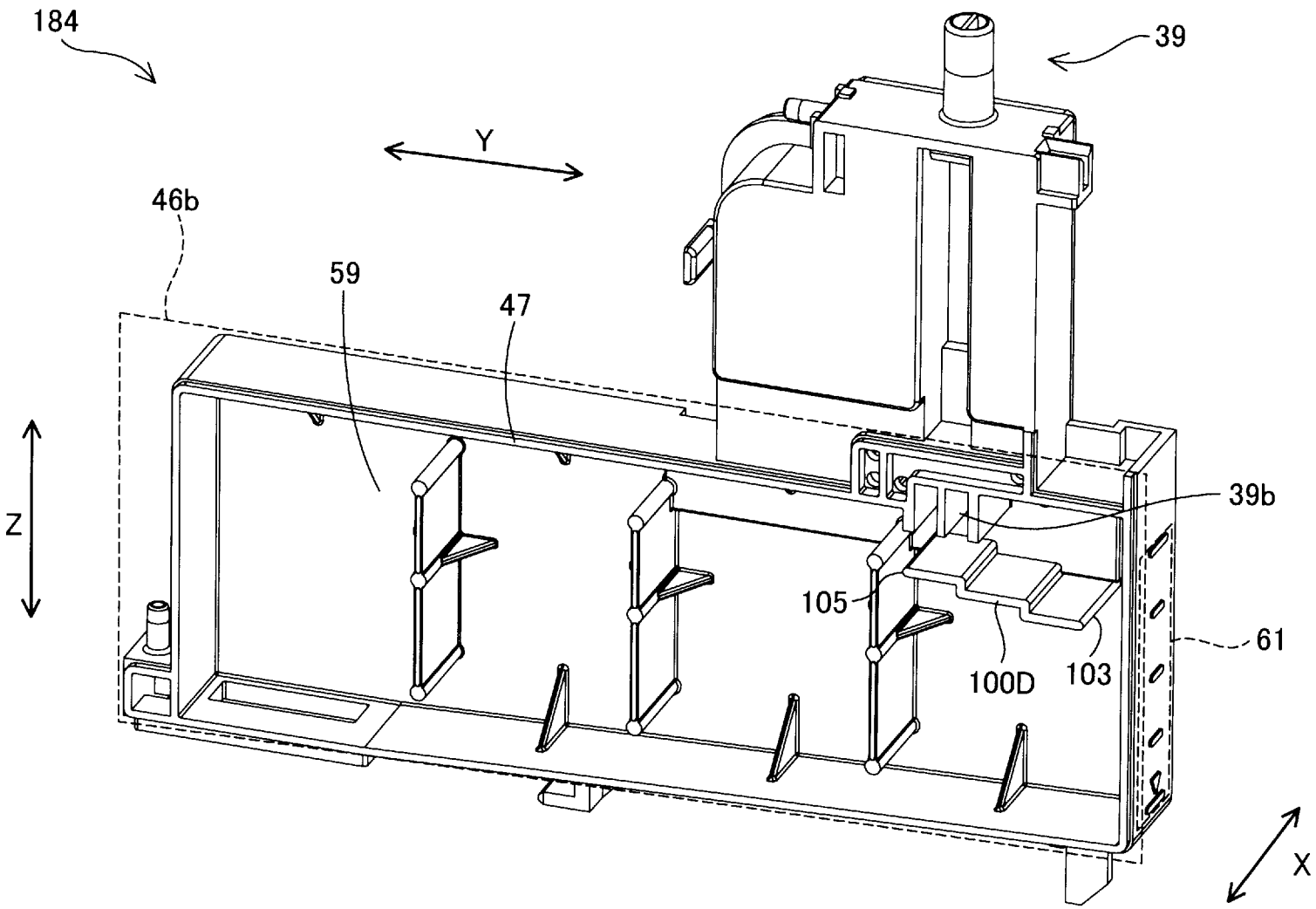
FIG. 15 is a perspective view of the ink tank according to the fourth embodiment as viewed from the left side.

FIG. 14 is a left side view of an ink tank 184 according to a fourth embodiment. FIG. 15 is a perspective view of the ink tank 184 according to the fourth embodiment as viewed from the left side. The ink tank 184 of the present embodiment differs from the first embodiment in terms of the shape of the ink guide wall 100.

An ink guide wall 100D of the present embodiment, as in the first embodiment, includes the first portion 101 facing the ink inlet portion 39 in the vertical direction Z and the second portion 102 located between the first portion 101 and the ink viewing portion 61 in the horizontal direction. The ink guide wall 100D has a step shape, the height of which decreases in the depth direction Y toward the ink viewing portion 61. Therefore, in the present embodiment, the height of the second portion 102 is smaller than that of the first portion 101. In addition, in the present embodiment, the recessed portion 104 is not formed in the second portion 102, and the width of the viewing-portion-side end 103 in the width direction X is the same as the width of the first portion 101.

Also in the ink tank 184 of the fourth embodiment described above, as in the first embodiment, because ink is guided from the ink inlet portion 39 to the ink viewing portion 61 by the ink guide wall 100C, it is easy for the user to view the start of ink supply. Further, also in the present embodiment, as in the first embodiment, the second portion 102 may have the recessed portion 104 and the width of the viewing-portion-side end 103 may be smaller than the width of the ink viewing portion 61.

E. Other Embodiments (E-1) Although the window 21 illustrated in FIG. 1 is formed as a through hole in the above embodiment, the window 21 may be formed by forming the portion of the casing 20 that faces the ink viewing portion 61 so as to be transparent. That is, the window 21 may be formed as a transparent window. In this case, at least some of the upper limit mark 63, the lower limit mark 62, and the graduation 89 may be omitted from the ink viewing portion 61, and at least one of the upper limit mark 63, the lower limit mark 62, and the graduation 89 may be formed on the window 21 included in the casing 20.

(E-2) In the above embodiment, the ink inlet portion 39 includes the two ink flow channels 74*a* and 74*b*. However, the ink inlet portion 39 may be formed to have one ink flow channel. In addition, the ink inlet portion 39 may have a configuration having three or more ink flow channels.

(E-3) In the above embodiment, the ink viewing portion 61 extends in the vertical direction. On the other hand, the ink viewing portion 61 may extend in a diagonal direction intersecting the vertical direction.

(E-4) In the above embodiment, the viewing-portion-side end 103 of the ink guide wall 100 is at a position lower than the upper limit mark 63. On the other hand, the viewing-portion-side end 103 may be at a position higher than the upper limit mark 63.

(E-5) In the above embodiment, the ink viewing portion 61 is provided with the upper limit mark 63, the lower limit mark 62, and the graduation 89; however, all or some of the aforementioned need not be provided.

(E-6) In the above embodiment, by providing the recessed portion 104 in the ink guide wall 100, a space is provided between the ink guide wall 100 and a portion of the second film 46*b*. On the other hand, the whole of the ink guide wall 100 and the second film 46*b* may be separated. In this case, for example, the ink guide wall 100 may be inclined so that the second film 46*b* side of the ink guide wall 100 is vertically higher than the right wall 59 side. In addition, an end of the ink guide wall 100 on the second film 46*b* side may stand upright.

(E-7) In the above embodiment, the ink tank 18 is provided in the printer 12 of the multifunction machine 11 having the image reading device 13; however, the ink tank 18 may be provided in a printer not having the image reading device 13.

(E-8) In the above embodiment, the ink tank 18 is fixed in the tank unit 19 disposed on the front surface side of the casing 20. On the other hand, the ink tank 18 may be mounted on the carriage 26. That is, the ink tank 18 may be configured to reciprocate along the width direction X together with the carriage 26.

(E-9) The present disclosure can be applied not only to a printer and an ink tank thereof, but also to liquid ejecting apparatuses that consume a liquid other than ink and the liquid tank used for those liquid ejecting apparatuses. For example, the present disclosure is applicable as a liquid tank used in various liquid ejecting apparatuses as described below.

(1) An image recording apparatus such as a facsimile machine.

(2) A color material ejecting apparatus used in the production of color filters for image display devices such as liquid crystal displays.

(3) An electrode material ejecting apparatus used for forming electrodes of an organic electroluminescence (EL) display, a surface emitting display (field emission display (FED), and the like.

(4) A liquid ejecting apparatus that ejects a liquid containing biological organic matter used for producing a biochip.

(5) A sample ejecting apparatus as a precision pipette.

(6) A lubricant ejecting apparatus.

(7) A resin liquid ejecting apparatus.

(8) A liquid ejecting apparatus that ejects lubricating oil pinpoint to a precision machine such as a watch or a camera.

(9) A liquid ejecting apparatus that ejects a transparent resin liquid such as an ultraviolet-cured resin liquid onto a substrate in order to form a micro hemispherical lens (optical lens) or the like used for an optical communication element or the like.

(10) A liquid ejecting apparatus that ejects an acidic or alkaline etching solution for etching a substrate or the like.

(11) A liquid ejecting apparatus including a liquid consumption head that ejects any other minute amount of droplets.

Further, the term "droplet" refers to a state of liquid discharged from a liquid ejecting apparatus, and includes granular, teardrop-like, and threadlike tails. In addition, the term "liquid" referred to here may be any material that can be consumed by the liquid ejecting apparatus. For example, the term "liquid" may refer to any material as long as the material is in a liquid phase, for example, liquid materials such as materials having a high or low viscosity state, sols, gel water, other inorganic solvents, organic solvents, liquid resin and liquid metal (metal melt) are also covered by the term "liquid". In addition, not only liquid as one state of matter, but also particles of a functional material composed of a solid material such as pigment and metal particles dissolved, dispersed or mixed in a solvent are covered by the term "liquid". Representative examples of the liquid include ink, liquid crystals, and the like as described in the above embodiment. Herein, examples of ink include various liquid compositions such as general water-based ink and oil-based ink, gel ink, hot melt ink and the like.

F. Other Aspects

The disclosure is not limited to the above-described embodiment, and can be realized in various configurations without departing from the gist thereof. For example, the technical features of the embodiments corresponding to the technical features in each of the aspects described below may be used to solve some or all of the above-mentioned problems, and may be replaced or combined as necessary in order to accomplish some or all of the effects of the disclosure. In addition, unless technical features are described as essential in this specification, they can be deleted as appropriate.

(1) According to one aspect of the present disclosure, an ink tank that communicates with an ink ejecting head is provided. The ink tank includes: an ink chamber configured to house ink; an ink inlet portion that communicates with the ink chamber and that receives ink supplied from an ink supply container; and an ink viewing portion that is a portion of a wall that defines the ink chamber and that enables the ink in the ink chamber to be viewed from an outside, the ink chamber having an ink guide wall for guiding the ink from the ink inlet portion toward the ink viewing portion.

According to the ink tank of such an aspect, because the ink is guided from the ink inlet portion toward the ink viewing portion by the ink guide wall, the user can easily view the start of ink supply. Therefore, the possibility of contamination of the periphery of the ink inlet portion with ink due to, for example, the user spattering the ink from the ink supply container by forcibly squeezing the ink supply container for ink replenishment or removing the ink supply container from the ink inlet portion in suspicion of incorrect insertion of the ink supply container is reduced.

(2) In the ink tank according to the above aspect, the ink viewing portion may extend in a vertical direction, and the ink guide wall may include a first portion facing the ink inlet portion in the vertical direction, and a second portion located between the first portion and the ink viewing portion in a horizontal direction. With such an aspect, it is easy to guide the ink to the ink viewing portion.

(3) In the ink tank of the above aspect, the second portion may have a viewing-portion-side end that faces the ink viewing portion, and a width of the viewing-portion-side end may be smaller than a width of the ink viewing portion. With such a configuration, it is possible to easily view the amount of ink rising from the lower side through a portion of the ink viewing portion that does not face the viewing-portion-side end of the ink guide wall. Therefore, it can be easily recognized whether the replenishment of ink is being performed smoothly.

(4) In the ink tank of the above aspect, the ink viewing portion may include an upper limit mark that is a guide for an upper limit of an ink amount, and the viewing-portion-side end may be lower than the upper limit mark in the vertical direction. With such a configuration, it is possible to easily recognize when the amount of ink has reached the upper limit since the end on the side of the viewing portion is lower than the upper limit mark.

(5) In the ink tank of the above aspect, the second portion may be lower than the first portion in the vertical direction. With such a configuration, it is easy to guide the ink supplied from the ink inlet portion toward the ink viewing portion.

(6) In the ink tank according to the above aspect, the first portion may include an upright wall portion standing upright at an end opposite to a side of the ink viewing portion. With such a configuration, it is possible to make it difficult for the ink received from the ink inlet portion to escape to the side opposite to the ink viewing-portion-side. Therefore, it is easy to guide the ink toward the ink viewing portion.

(7) In the ink tank of the above aspect, the ink guide wall may be spaced apart from a portion of a side wall defining the ink chamber. With such a configuration, the air below the ink guide wall can easily escape to the upper side of the ink guide wall through the gap, and the ink can be supplied smoothly.

The present disclosure is not limited to the aspects as the ink tank described above, and various aspects such as a printer provided with the ink tank, an ink supply system provided with the printer, the ink tank, and the ink supply container, an ink supply method, and the like can be realized.

What is claimed is:

1. An ink tank that communicates with an ink ejecting head, comprising:

an ink chamber configured to house ink;

an ink inlet portion that communicates with the ink chamber and that receives ink supplied from an ink supply container;

an ink viewing portion that is a portion of a wall that defines the ink chamber and that enables the ink in the ink chamber to be viewed from an outside; and the ink chamber has an ink guide wall for guiding the ink;

wherein the guide wall guides the ink from the ink inlet portion directly toward the ink viewing portion, by causing the ink to flow above and along the guide wall.

2. The ink tank according to claim 1, wherein the ink viewing portion extends in a vertical direction, and the ink guide wall includes a first portion facing the ink inlet portion in the vertical direction, and a second portion located between the first portion and the ink viewing portion in a horizontal direction.

3. The ink tank according to claim 2, wherein the second portion has a viewing-portion-side end that faces the ink viewing portion, and a width of the viewing-portion-side end is smaller than a width of the ink viewing portion.

4. The ink tank according to claim 3, wherein the ink viewing portion includes an upper limit mark that is a guide for an upper limit of an ink amount, and the viewing-portion-side end is lower than the upper limit mark in the vertical direction.

5. The ink tank according to claim 2, wherein the second portion is lower than the first portion in the vertical direction.

6. The ink tank according to claim 2, wherein the first portion includes an upright wall portion standing upright at an end opposite to a side of the ink viewing portion.

7. The ink tank according to claim 1, wherein the ink guide wall is spaced apart from a portion of a side wall defining the ink chamber.

* * * * *